United States Patent [19]

Inge et al.

[11] Patent Number: 5,024,648

[45] Date of Patent: Jun. 18, 1991

[54] CENTRIFUGAL SEPARATOR WITH A DISCHARGE DEVICE

[75] Inventors: Claes Inge, Saltsjö-Duvnäs; Peter Franzén, Tullinge; Torgny Lagerstedt, Stockholm; Leonard Borgström, Bandhagen; Claes-Göran Carlsson, Tullinge; Hans Moberg, Stockholm; Olle Nåbo, Tullinge, all of Sweden

[73] Assignee: Alfa-Laval Separation AB, Tumba, Sweden

[21] Appl. No.: 458,622

[22] PCT Filed: Oct. 4, 1988

[86] PCT No.: PCT/SE88/00510

§ 371 Date: Jan. 17, 1990

§ 102(e) Date: Jan. 17, 1990

[87] PCT Pub. No.: WO89/03250

PCT Pub. Date: Apr. 20, 1989

[30] Foreign Application Priority Data

Oct. 8, 1987 [SE] Sweden ..... 87038840

[51] Int. Cl.[5] ..... B04B 11/00

[52] U.S. Cl. ..... 494/56; 494/68

[58] Field of Search ..... 494/56, 57, 58, 59, 494/68, 74, 80; 210/781, 782, 360.1

[56] References Cited

U.S. PATENT DOCUMENTS

| | | | |
|---|---|---|---|
| 2,302,381 | 11/1942 | Scott | 233/28 |
| 3,371,858 | 3/1968 | Shapiro | 233/14 |
| 3,494,544 | 2/1970 | Thylefors | 494/59 |
| 4,210,275 | 7/1980 | Zettier | 233/20 R |
| 4,718,887 | 1/1988 | Gunn | 494/58 |
| 4,729,759 | 3/1988 | Krook | 494/56 |

FOREIGN PATENT DOCUMENTS

| | | |
|---|---|---|
| 0225707 | 6/1987 | European Pat. Off. . |
| 2400390 | 3/1979 | France . |
| 422536 | 3/1982 | Sweden . |
| 607938 | 12/1978 | Switzerland . |

*Primary Examiner*—Robert W. Jenkins

*Attorney, Agent, or Firm*—Seidel, Gonda, Lavorgna & Monaco

[57] ABSTRACT

The present invention concerns a centrifugal separator comprising a rotor, which forms an inlet (12) for a liquid mixture, a separation chamber (5), connected to the inlet (12), for separation of components in a liquid formed mixture and a discharge chamber (10). The discharge chamber is delimited by two axially separated end walls (12, 13) and a circumferential wall (14) extending between these and has an inlet (11, 11*a*) connected to the separation chamber (5), an outlet in a discharge device (17) arranged in the discharge chamber (10), and means, which together with parts of the inner surfaces of the discharge chamber (10) are arranged, during operation of the rotor, to entrain into rotation a component present in the discharge chamber (10) so that this forms a rotating liquid body. This liquid body has a radially inwards directed, essentially cylindrical, free liquid surface radially inside the circumferential wall (14). The discharge device (17) extends during operation from a central liquid free, part of the discharge chamber (10) to a level radially outside the free liquid surface. In order to gently into rotation entrain the component present in the discharge chamber (10) and make a discharge possible out of it with a small degree of air admixing the centrifugal separator according to the invention is provided with entraining means comprising at least one annular disc (19, 19*a*, 19*b*, 19*c*) extending around the rotational axis of the rotor which is fixedly connected to the rotor and has at least one part extending radially outside the level of the free liquid surface but radially inside the level of the outermost part of the discharge device (17).

20 Claims, 5 Drawing Sheets

CENTRIFUGAL SEPARATOR WITH A DISCHARGE DEVICE

Figure 1:
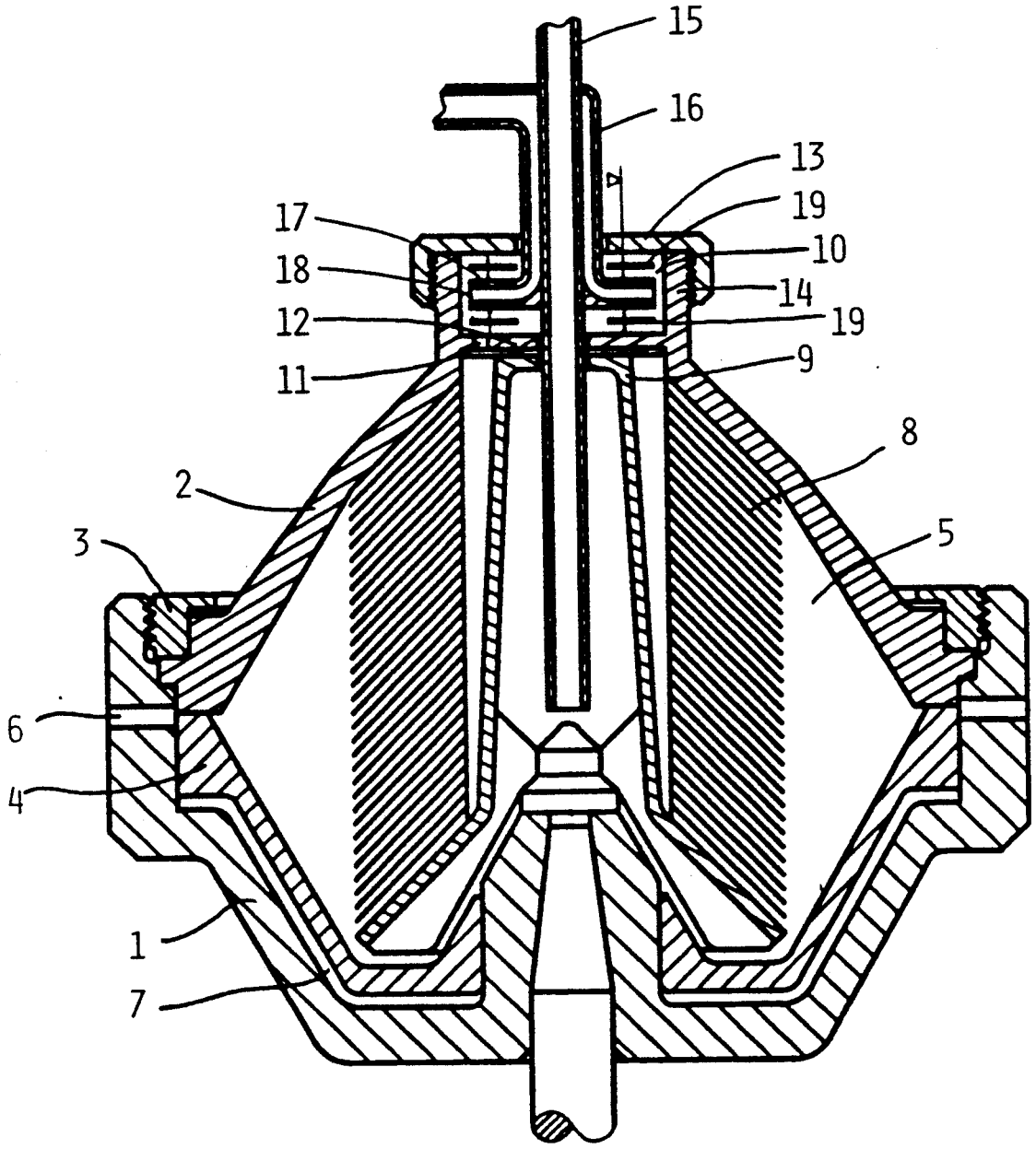

The present invention concerns a centrifugal separator comprising a rotor, which forms an inlet for a liquid mixture, a separation chamber, connected to the inlet, for separation of components in the liquid mixture and a discharge chamber. The discharge chamber is delimited by two axially separated end walls and a circumferential wall extending between these and which has an inlet connected to the separation chamber, an outlet in a discharge device arranged in the discharged chamber and means, which together with parts of inner surfaces of the discharge chamber are arranged, during operation of the rotor, to entrain into rotation a liquid component present in the discharge chamber so that this forms a rotating liquid body. This liquid body has a radially inwards directed annular free liquid surface radially inside the circumferencial wall. The discharge device extends during operation from a liquid free central part of the discharge chamber to a level radially outside the free liquid surface.

In hitherto known centrifugal separators of this kind said entraining means consists of wings in the discharge chamber, which has an axially and a radially extension. The during operation of the rotor rotating liquid body in the discharge chamber then will be in contact with wings and in contact with the part of the discharge device extending radially outside the level of the free liquid surface of the rotating liquid body. The discharge device, which is stationary or rotates with a lower rotational speed than the rotor, then slows down the rotational movement of the liquid body while the rotating wings entrains the liquid body in the rotational movement of the rotor. Hereby, different parts of the liquid body will obtain different rotational speeds and be influenced by different centrifugal forces. This creates an internal circulation inside the discharge chamber, a liquid formed component flowing radially inwards in layers along the outside of the discharge device and radially outwards in layers along the wings. The flow rate of the component at the free liquid surface and along the wings can then be considerable, which means an increased risk of having air or another gas present radially inside the free liquid surface entrained by the flowing component and to follow it out through the inlet of the discharge device and further out through the outlet. A part of the entrained air then might be dissolved in the separated component while a part is entrained in the form of air bubbles. Besides, entraining means in the form of such wings also creates mechanical strains on the separated component, which in many cases has a damaging influence on the same.

To decrease the admixture of air in the component flowing through the outlet the radial distance between the free liquid surface and the inlet of the discharge device can be increased. A part of the air which has been entrained by the separated component at the liquid surface and which follows it radially outwards towards the inlet of the discharge device is separated in the form of air bubbles, which move radially inwards towards the free liquid surface. The greater the radial distance is between the free liquid surface and the inlet of the discharge device the less admixture of air is obtained in the discharged component.

The problem described above is present especially in centrifugal separators, in which the discharge chamber is open towards the surroundings of the rotor via a gap between the radially innermost edge of the discharge chamber and the discharge device. This edge limits the possibility in these centrifugal separators to increase said distance. In many cases this means that an air free component can not be obtained.

The object of the present invention is to provide a centrifugal separator of the kind initially described, in which a separated component can be discharged out of the discharge chamber having a small degree of air admixture and be entrained gently in the discharge chamber.

This is achieved according to the invention by the fact that said entraining means in the centrifugal separator of this kind comprises at least one disc, which is fixedly connected to the rotor. The disc, which extends around the rotational axis of the rotor has at least a part extending radially outside the level of the free liquid surface but radially inwards the level of the outermost part of the discharge device. In a preferred embodiment at least one of said discs is arranged nearby, preferably parallel to, a surface of the outside of the discharge device directed essentially axially, an interspace being formed between said disc and said surface.

By this design of a centrifugal separator an entrainment necessary for a wanted discharge of a separated component present in the discharge chamber can be obtained while, however, a part of the separated component present nearby the discharge device is entrained in less degree than in hitherto known centrifugal separators.

Hereby, a reduction of the radially inwardly directed flow is achieved, which by necessity is obtained nearby the discharge device as a result of the fact that this does not rotate at the same speed as the separated component. This means in turn that the above discussed internal circulation is reduced.

An advantage, which also can be achieved by this design, is that the during operation existing radially outwardly directed flow in the discharge chamber is distributed evenly over one or more layers with a large cross sectional area along at least one disc The local maximum speeds of the radially flow hereby will be low. The radially outwardly directed flow can be distributed on two interspaces separated by a disc or more if more than one disc are used, which lowers the speed of the flow further and its entraining effect on the air.

By designing the entraining means in this manner the contact between the separated component is taking place over large areas, which means a gentle treatment of the separated component.

Figure 2:
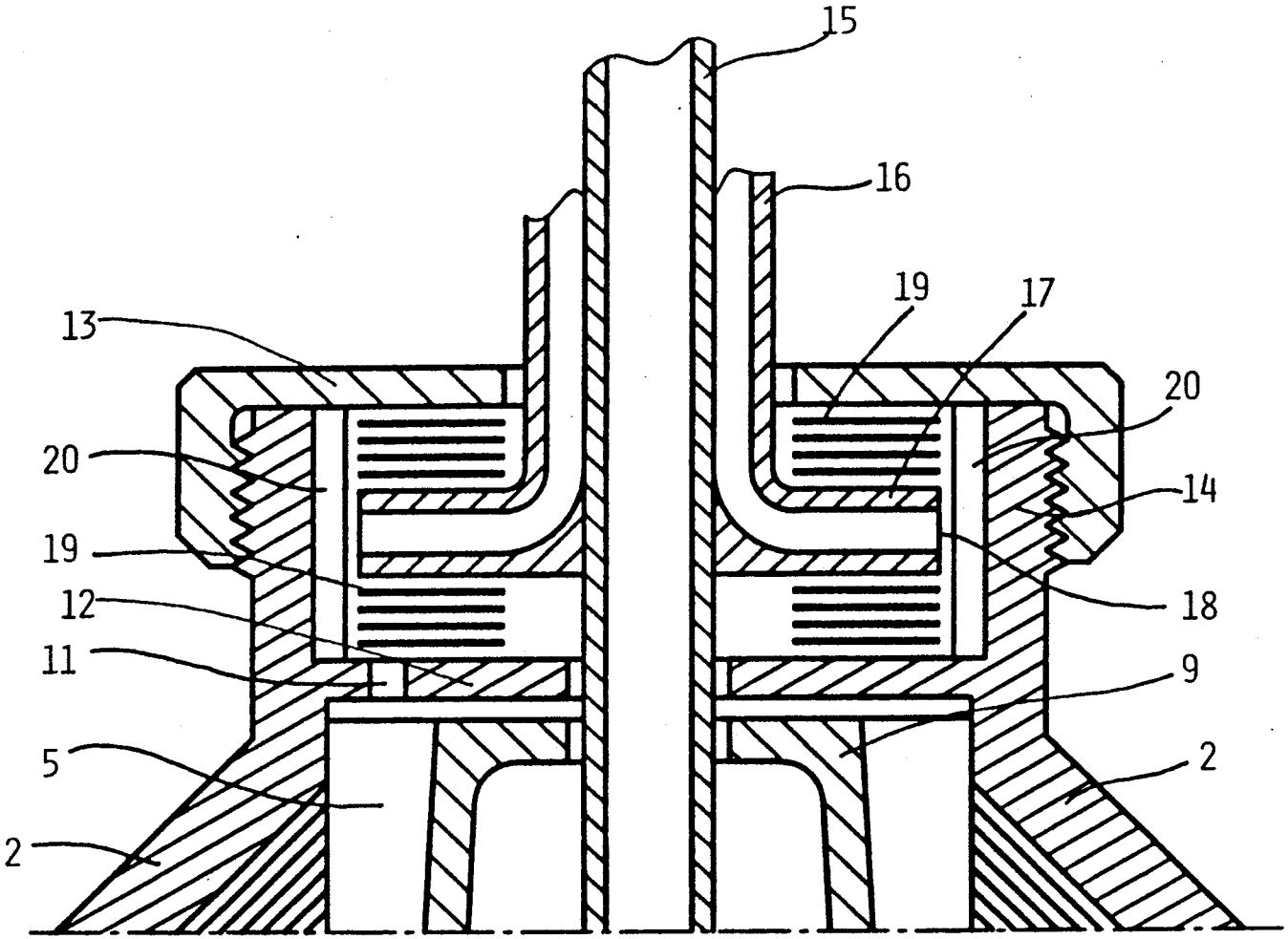
Figure 3:
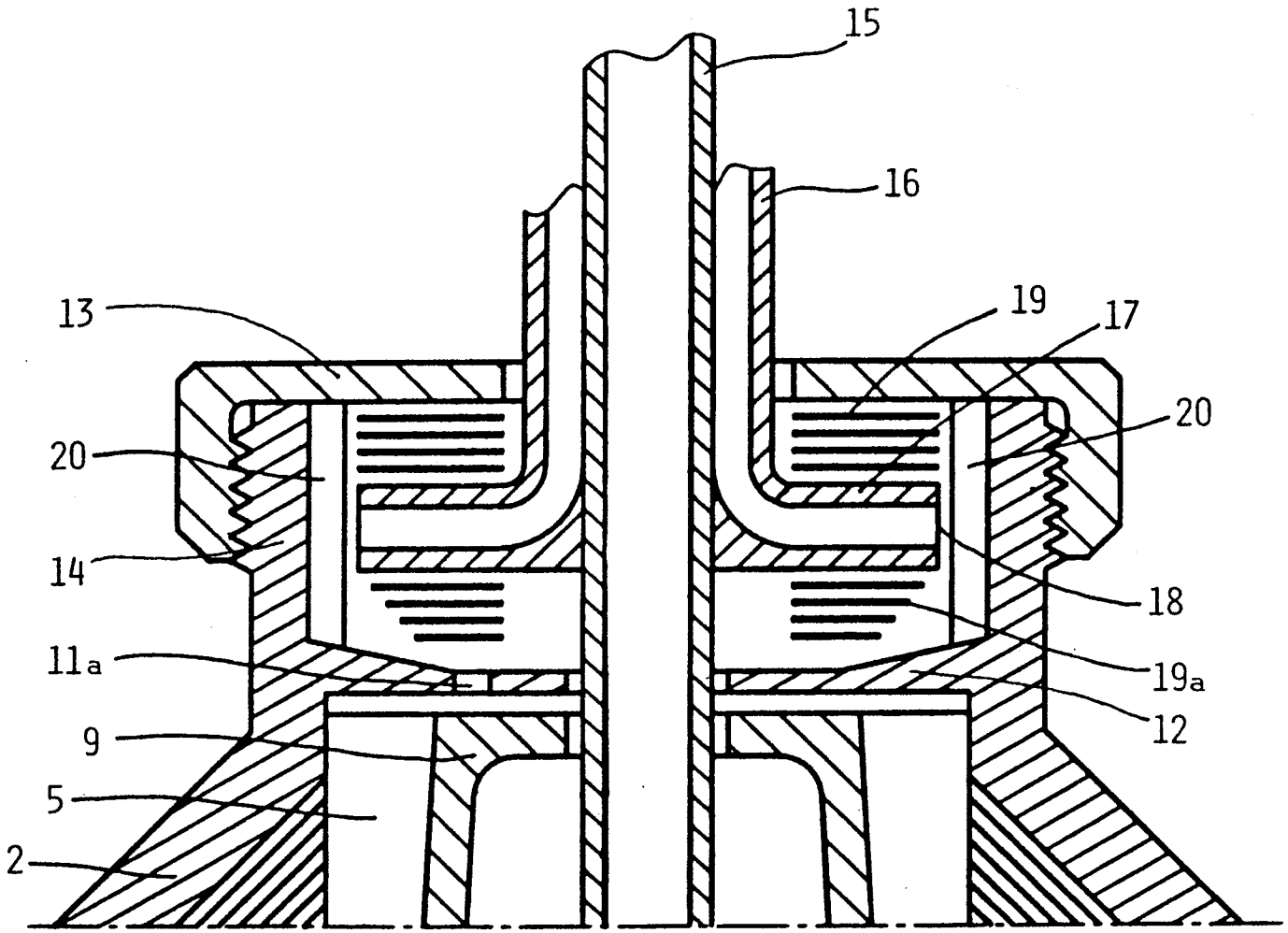
Figure 4:
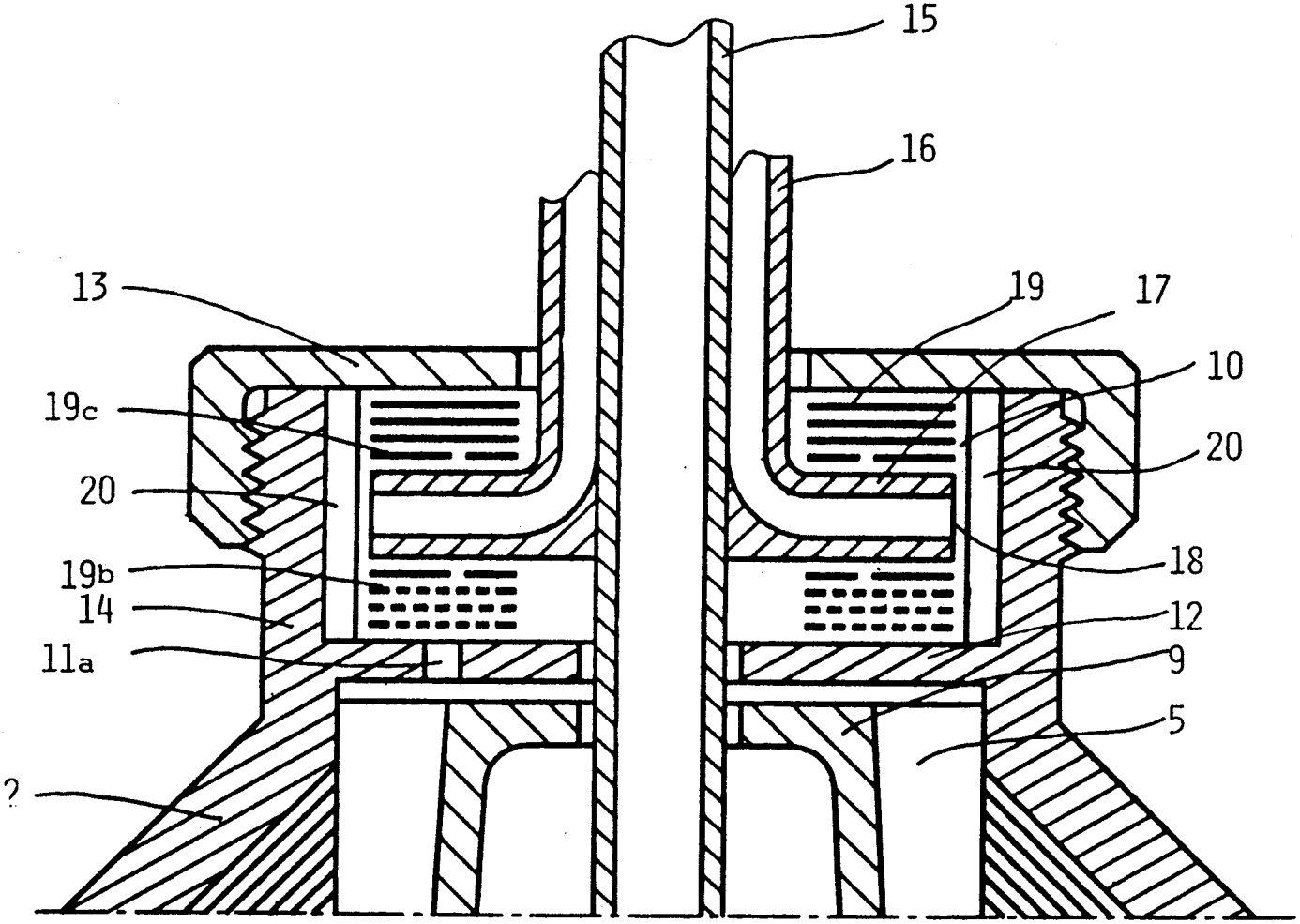
Figure 5:
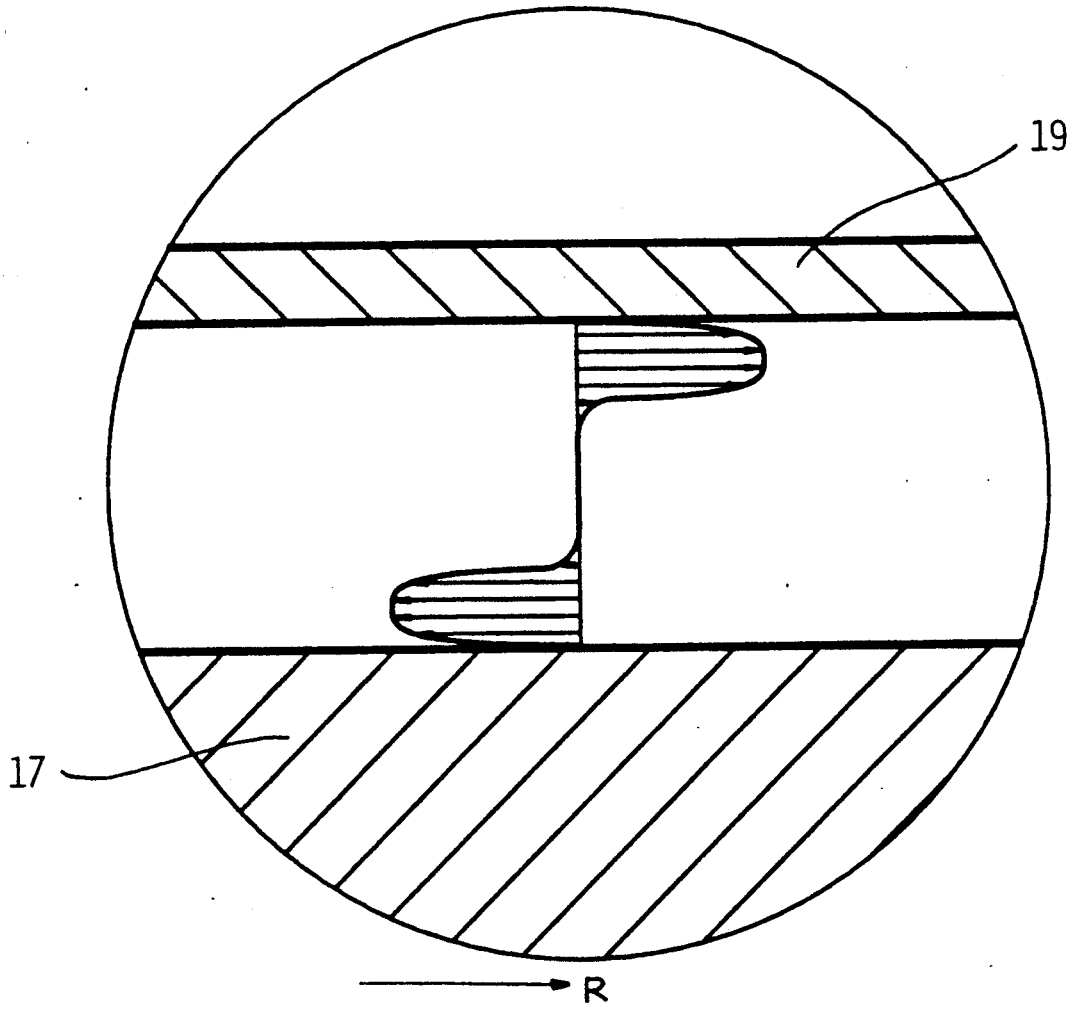

The invention will be described in more detail in the following with reference to the accompanying drawings, on which FIG. 1 shows an axial section through a part of a centrifugal separator according to the invention, FIG. 2 shows schematically an axial section through a part of a centrifugal separator according to another embodiment of the invention, FIG. 3 shows schematically an axial section through a part of a centrifugal separator according to a third embodiment of the invention, FIG. 4 shows schematically an axial section through a part of a centrifugal separator according to a fourth embodiment of the invention, and FIG. 5 shows a speed profile of the radial flow in an interspace between the discharge device and a disc next to it.

The centrifugal separator shown in FIG. 1 comprises a rotor having a lower part 1 and an upper part 2, which are joined together by a locking ring 3. Inside the rotor there is arranged a valve slide 4. This valve slide 4 delimits together with the upper part 2 a separation chamber 5 and is arranged to open and close an annular gap at the outermost periphery of the separation chamber 5 between the separation chamber 5 and outlet openings 6 for a component having been separated out of a liquid mixture supplied to the rotor and been collected at the periphery of the separation chamber 5. The valve slide 4 delimits together with the lower part 1 a closing chamber 7, which is provided with an inlet and a throttled outlet for a closing liquid. These in- and outlets are not shown in the figure.

Inside the separation chamber 5 a disc stack 8 consisting of a number of conical separation discs is arranged between a distributor 9 and the upper part 2. The upper part 2 forms at its in the figure shown upper end a discharge chamber 10, into which a specifically lighter liquid component in the mixture can flow out of the separation chamber 5 via an inlet 11. The discharge chamber 10 is delimited by two axially separated end walls 12, 13 and a circumferential wall 14 extending between these.

Centrally through the discharge chamber 10 a stationary inlet tube 15 is arranged, which opens into the interior of the distributor 9. Around this inlet tube 15 a stationary outlet tube 16 is arranged for the specifically lighter component, which extends into the discharge chamber 10. Inside the discharge chamber 10 a stationary discharge device 17 is arranged around the inlet tube 15. The discharge device 17 extends from the central inlet tube radially out in the discharge chamber 10 and is provided with at least one inlet 18 at its greatest radius, which communicates with the internal of the outlet tube 16.

In the discharge chamber 10 two discs 19 are arranged axially on each side of the discharge device 17 fixedly connected to the rotor for the entrainment of the separated component present in the discharge chamber. The discs 19 are designed with a part that surrounds the axis of the rotor and is located during operation in the rotating liquid body, i.e. radially outside the radially inwardly directed free liquid surface in the discharge chamber 10 formed by the separated component. The inlet 18 arranged in the discharge device 17 is then also located in the liquid body.

The embodiment shown in FIG. 2 differs from the one shown in FIG. 1 in that several discs 19 are arranged axially on each side of the discharge device 17 and that entraining wings 20 are arranged at the radially outermost part of the discharge chamber 10.

In the two embodiments according to FIGS. 1 and 2 the inlets 11 between the separation chamber 5 and the discharge chamber 10 are located on a radius nearby the radial level at which the inlets 18 are arranged. The inlet 11*a* in the embodiment according to FIG. 3 is on the other hand arranged through the end wall 12 at a radius, which is less than the radius, at which the inlet 18 is arranged.

In this embodiment the discs 19*a* have been designed with an outer radius which decreases with the distance from the discharge device 17 of the disc. On the opposite side axially to the discharge device 17 the discs 19 are of the same design as the ones shown in FIG. 2.

In FIG. 4 another embodiment is shown, in which the discs 19*b* in the discharge chamber 10 between the inlet 11*a* and the discharge device 17 are provided with holes through which the component can flow axially. The discs 19*c* closest to, axially on both sides of the discharge device 17, can as shown in FIG. 4 be provided with a less number of holes located at a smaller radius than the radius at which the inlet 18 is arranged. The other discs 19 in the part of the discharge chamber 10 turned from the inlet 11*a* can as shown in FIG. 2 be of the same kind as the discs shown in FIG. 2.

In FIG. 5 there is shown an axial section through a part of an interspace between the discharge device 17 and a disc 19 next to it connected to the rotor. In the interspace there is drawn a radial speed profile, which shows how the radial flow might be in the interspace at a radius R. In a layer closest to the discharge device 17 the component flows radially inwards, whereas it flows radially outwards in a layer closest to the disc rotating with the rotor. In a layer between these two layers no radial flow in this case is taking place, but only tangential flow exists in this layer.

A centrifugal separator designed according to the invention functions in the following manner:

Upon start of the centrifugal separator the rotor is brought to rotate and the separation chamber 5 is closed by supplying a closing liquid to the closing chamber 7 through the inlet (not shown). When the separation chamber 5 is closed the liquid mixture, which shall be centrifugated can be supplied to the separation chamber 5 through the inlet tube 15 and the distributor 9. Gradually the separation chamber 5 is filled up, the rotor gets operational number of revolutions and the conditions are stabilized inside the separation chamber. The components in the liquid mixture are separated by the influence of centrifugal forces acting on the same.

The separation is then mainly taking place in the spaces between the conical discs in the disc stack 8. During the separation specifically heavier components of the mixture is thrown radially outwards and is collected in the radially outermost part of the separation chamber, whereas a specifically lighter liquid component flows radially inwards in these spaces.

The specifically heavier mixture component is removed intermittently during operation by bringing the valve slide 4 to uncover the peripheral outlet openings 6 during time periods.

The specifically lighter liquid component flows out of the separation chamber 5 through the inlet 11 to the discharge chamber 10, in which it forms a rotating liquid body with a radially inwards directed free liquid surface. The liquid component present in the discharge chamber 10 is discharged through the stationary discharge device 17 via its inlet 18. The entrainment of the liquid component present in the discharge chamber 10 is effected gently by the discs 19 rotating with the rotor and by other inner surfaces of the walls of the separation chamber. The separated liquid component present in the inter-space closest to the discharge device 17 is entrained only by its contact with the disc 19 located closest to the discharge device 17 whereas it is slowed down by its contact with the outer surfaces of the discharge device 17. Thereby, different parts of the liquid volume present in the discharge chamber 10 will obtain different rotational speed. The contact between the liquid component and the outer surfaces of the discharge device 17 means that a circulating flow in the discharge chamber 10 is generated, the liquid component flowing radially inwards along the outer surfaces of the discharge device 17 and radially outwards along axially directed surfaces of the discs 19 and along the inner surfaces of the walls of the discharge chamber 10. Since the part of the liquid body present in the interspace closest to the discharge device 17 only is entrained partly in the rotation of the rotor, the difference in rotational speed between the liquid body in this interspace and the discharge device becomes small, whereby also the flow radially inwards and consequently the internal circulation becomes small. How the radial flow in the interspace between the discharge device 17 and a disc 19 next to it might be is illustrated in FIG. 5, in which a speed profile for the radial flow in the interspace has been drawn.

This flow radially outwards and the possible radially outwards directed flow as a consequence of the flow through the discharge chamber 10 is then distributed over relatively large layers close to the discs. Hereby, the local maximum flow rate can be kept low, which is specially important at the free liquid surface because the danger for air admixture is especially great there.

The number of discs can easily, as shown in FIG. 2, be adjusted to the present need for entrainment. It is also possible to complement the discs with entraining wings 20 (as shown in FIGS. 2, 3 and 4), which have an axial and radial extension in the discharge chamber 10. Preferably these are then arranged at a radially outer part of the discharge chamber 10.

The radial flow in the discharge 10 as a consequence of the flow through the same can be diminished or eliminated by arranging the inlet 11 at essentially the same radius as the radius, at which the inlet 18 is arranged, as shown in FIGS. 1 and 2.

However, sometimes it is necessary to place the inlet 11*a* radially inside said inlet 18 as shown in FIGS. 3 and 4, to be able to maintain the different liquid levels inside the separation chamber at wanted radius.

In these cases it is suggested that the discs located between the passage 11*a* and the discharge device 17 are designed with an outer radius, which decreases with an increasing distance from the discharge device 17, as shown in FIG. 3, or that these discs are provided with holes, which is shown in FIG. 4, to facilitate an axial flow through the different interspace and towards the inlet 18.

Discs 19*b* provided with holes can naturally also be used in the part from the discharge chamber which is turned from the inlet 11 or 11*a* whereby liquid component can flow over to other interspaces and the entraining effect from the discs can be better used. The discs 19*c* closest to the discharge device 17 are preferably provided with a less number of holes located at a for the application suitable radial distance inside the inlet. Hereby, the entraining effect of these discs can be kept at a high level, and an overflow to adjacent space is taking place when the free liquid surface of the liquid component in the interspace between the discharge device 17 and the adjacent disc 19*c* is at or radially inside these holes, i.e. when there is a need to increase the entraining effect.

Of course it is quite possible to achieve the same adjustment of the entraining effect of the discs 19 to the need thereof by designing these with inner radius which increases with the increasing distance from the discharge device.

In the shown examples the component present in the discharge chamber 10 consists of a specifically lighter liquid phase. Naturally, the invention also can be implied for discharge of a specifically heavier liquid component. The adherent outlet passage is then connected with channels, which are in connection with outer parts of the separation chamber.

I claim:

1. Centrifugal separator comprising: a rotor having an inlet for a liquid mixture, a separation chamber connected to the inlet, the separation chamber for separation of components of the liquid mixture, and a discharge chamber delimited by two axially separated end walls and a circumferential wall extending between the end walls, the discharge chamber having a discharge inlet connected to the separation chamber, a discharge device arranged in the discharge chamber, the discharge device having an outlet, and means which together with parts of the inner surfaces of the discharge chamber arranged, during operation of the rotor, to entrain into rotation a liquid component present in the discharge chamber so that it forms a rotating liquid body having a radially inward essentially circumferential free liquid surface positioned radially inside the circumferential wall, the discharge device during operation extending from a liquid free central part of the discharge chamber to a level radially inside the free liquid surface, said entraining means having at least one annular disc extending around the rotational axis of the rotor and fixedly joined to the rotor, at least one part of the entraining means extending radially outside the level of the free liquid surface but radially inside the level of the outermost part of the discharge device.

2. Centrifugal separator according to claim 1, wherein the disc is arranged close to, preferably parallel to, an essentially axially directed surface of the outside of the discharge device, and an interspace being formed between said disc and said surface.

3. Centrifugal separator according to claim 2, wherein the disc divides the discharge chamber into interspaces which communicate with each other via a non-restricting flow channel arranged essentially on the same radius as the inlet at the discharge device.

4. Centrifugal separator according to claim 2, wherein at least two discs are arranged axially on the same side of the discharge device and extend essentially parallel to an outside surface of the discharge device directed axially towards these discs, the discs dividing the discharge chamber into a series of interspaces between themselves and between said surface.

5. Centrifugal separator according to claim 2, wherein at least one disc extends radially outward to the radial level of the inlet of the discharge device.

6. Centrifugal separator according to claim 2, wherein said disc has at least one hole located between said free liquid surface and the outer radius of the disc for axial communication between the interspaces on each side of the disc.

7. Centrifugal separator according to claim 2, wherein two discs are provided with one disc arranged axially on each side of the discharge device.

8. Centrifugal separator according to claim 2, wherein the inlet of the discharge chamber is arranged through one end wall at essentially the same radial level as the inlet of the discharge device.

9. Centrifugal separator according to claim 2, wherein the inlet of the discharge chamber is arranged at a radial level inside the inlet of the discharge device.

10. Centrifugal separator according to claim 1, wherein two discs are provided with one disc arranged axially one each side of the discharge device.

11. Centrifugal separator according to claim 10, wherein said disc has at least one hole located between said free liquid surface and the outer radius of the disc for axial communication between the interspaces on each side of the disc.

12. Centrifugal separator according to claim 10, wherein the two discs are arranged axially on the same side of the discharge device, the discs extending essentially parallel to a surface outside of the discharge device directed towards the discs, the discs dividing the discharge chamber into interspaces between themselves and said surface.

13. Centrifugal separator according to claim 1, wherein the disc divides the discharge chamber into interspaces, which communicate with each other via a non-restricting flow channel.

14. Centrifugal separator according to claim 1 wherein at least two discs are arranged axially on the same side of the discharge device, the disks extending essentially parallel to a surface of the outside of the discharge device directed axially towards these discs, the discs dividing the discharge chamber in interspaces between themselves and said surface.

15. Centrifugal separator according to claim 1 wherein the inlet of the discharge chamber is arranged through one end wall at essentially the same radial level as the inlet of the discharge device.

16. Centrifugal separator according to claim 1 wherein the inlet of the discharge chamber is arranged at a radial level inside the inlet of the discharge device.

17. Centrifugal separator according to claim 7, characterized in that at least two discs (19, 19*a*, 19*b*, 19*c*) are arranged between the inlet (11, 11*a*) of the discharge chamber (10) and the discharge device (17), the outer radius of the discs (19*a*) decreasing with an increasing distance from the discharging device (17).

18. Centrifugal separator according to claim 1, wherein at least one disc extends radially outward to the radial level of the inlet (18) of the discharge device.

19. Centrifugal separator according to claim 1, wherein said disc has at least one hole located between said free liquid surface and the outer radius of the disc for axial communication between the interspaces on each side of the disc.

20. Centrifugal separator according to claim 1, wherein said entraining means further comprises at least one wing element fixedly joined to the rotor and extending radially and axially therefrom, at least one part of the wing element being located radially outside said free liquid surface.

* * * * *